US009556754B2

(12) United States Patent
Hattiangadi et al.

(10) Patent No.: US 9,556,754 B2
(45) Date of Patent: Jan. 31, 2017

(54) TRANSLATING ROLLER LIFTER DESIGN FOR DIESEL ENGINES

(71) Applicant: Caterpillar Inc., Peoria, IL (US)

(72) Inventors: Ashwin Ashok Hattiangadi, Edwards, IL (US); Terrence Lee Szmania, Chillicothe, IL (US); Brenton William Bush, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 89 days.

(21) Appl. No.: 14/559,591

(22) Filed: Dec. 3, 2014

(65) Prior Publication Data

US 2016/0160695 A1 Jun. 9, 2016

(51) Int. Cl.
*F01L 1/18* (2006.01)
*F01L 1/14* (2006.01)

(52) U.S. Cl.
CPC ..... *F01L 1/14* (2013.01); *F01L 1/146* (2013.01); *F01L 2101/00* (2013.01); *F01L 2107/00* (2013.01); *F01L 2810/02* (2013.01); *F01L 2820/01* (2013.01)

(58) Field of Classification Search
CPC ..... F01L 1/14; F01L 1/146; F01L 2810/02
USPC ..... 123/90.35, 90.48, 90.45
See application file for complete search history.

(56) References Cited

U.S. PATENT DOCUMENTS 3,822,683 A 7/1974 Clouse
5,307,778 A 5/1994 Hummel et al.
5,546,899 A 8/1996 Sperling et al.
7,658,173 B2 2/2010 Carroll et al.
7,748,359 B2 7/2010 Bartley et al.
7,878,169 B2 2/2011 Brinks
8,109,247 B2 2/2012 Wakade et al.
9,222,376 B2 * 12/2015 Massing ..... F01L 1/16
2006/0005797 A1 1/2006 Schubeck
2013/0199331 A1 8/2013 Himsel et al.

FOREIGN PATENT DOCUMENTS

JP 3991558 B2 10/2007

* cited by examiner

*Primary Examiner* — Ching Chang

(74) *Attorney, Agent, or Firm* — Leydig, Voit & Mayer, Ltd.

(57) ABSTRACT

A valve lifter assembly for an engine may include a valve lifter body, a roller pin mounted in the valve lifter body and having a crowned barrel portion, and a substantially cylindrical roller mounted about the crowned barrel portion of the roller pin. The roller may have a crowned outer surface with a cylindrical center portion having a constant outer diameter equal to a roller maximum outer diameter, and oppositely disposed variable outer diameter outer portions extending outwardly from either side of the cylindrical center portion toward corresponding roller ends of the roller with a roller outer diameter decreasing as the variable outer diameter outer portions extend outwardly from the cylindrical center portion. The valve lifter assembly may further include a clip having engagement surfaces that are machined to have complimentary shapes to corresponding engagement surfaces of the valve lifter body.

19 Claims, 5 Drawing Sheets

90

| Roller Outer Diameter Profile | | | | | |
|---|---|---|---|---|---|
| Distance From Roller Center (mm) | Roller OD (mm) | OD Change (mm) | Distance From Roller Center (mm) | Roller OD (mm) | OD Change (mm) |
| 0.0 | 23.62000000 | 0.00000000 | 3.6 | 23.61995626 | 0.00004374 |
| 0.1 | 23.62000000 | 0.00000000 | 3.7 | 23.61993864 | 0.00006136 |
| 0.2 | 23.62000000 | 0.00000000 | 3.8 | 23.61991544 | 0.00008456 |
| 0.3 | 23.62000000 | 0.00000000 | 3.9 | 23.61988530 | 0.00011470 |
| 0.4 | 23.62000000 | 0.00000000 | 4.0 | 23.61984666 | 0.00015334 |
| 0.5 | 23.62000000 | 0.00000000 | 4.1 | 23.61979772 | 0.00020228 |
| 0.6 | 23.62000000 | 0.00000000 | 4.2 | 23.61973638 | 0.00026362 |
| 0.7 | 23.62000000 | 0.00000000 | 4.3 | 23.61966024 | 0.00033976 |
| 0.8 | 23.62000000 | 0.00000000 | 4.4 | 23.61956658 | 0.00043342 |
| 0.9 | 23.62000000 | 0.00000000 | 4.5 | 23.61945234 | 0.00054766 |
| 1.0 | 23.62000000 | 0.00000000 | 4.6 | 23.61931408 | 0.00068592 |
| 1.1 | 23.62000000 | 0.00000000 | 4.7 | 23.61914792 | 0.00085208 |
| 1.2 | 23.62000000 | 0.00000000 | 4.8 | 23.61894958 | 0.00105042 |
| 1.3 | 23.62000000 | 0.00000000 | 4.9 | 23.61871424 | 0.00128576 |
| 1.4 | 23.62000000 | 0.00000000 | 5.0 | 23.61843664 | 0.00156336 |
| 1.5 | 23.62000000 | 0.00000000 | 5.1 | 23.61811096 | 0.00188904 |
| 1.6 | 23.62000000 | 0.00000000 | 5.2 | 23.61773076 | 0.00226924 |
| 1.7 | 23.62000000 | 0.00000000 | 5.3 | 23.61728904 | 0.00271096 |
| 1.8 | 23.62000000 | 0.00000000 | 5.4 | 23.61677814 | 0.00322186 |
| 1.9 | 23.62000000 | 0.00000000 | 5.5 | 23.61618966 | 0.00381034 |
| 2.0 | 23.62000000 | 0.00000000 | 5.6 | 23.61551456 | 0.00448544 |
| 2.1 | 23.62000000 | 0.00000000 | 5.7 | 23.61474292 | 0.00525708 |
| 2.2 | 23.62000000 | 0.00000000 | 5.8 | 23.61386412 | 0.00613588 |
| 2.3 | 23.62000000 | 0.00000000 | 5.9 | 23.61286658 | 0.00713342 |
| 2.4 | 23.62000000 | 0.00000000 | 6.0 | 23.61173790 | 0.00826210 |
| 2.5 | 23.62000000 | 0.00000000 | 6.1 | 23.61046470 | 0.00953530 |
| 2.6 | 23.62000000 | 0.00000000 | 6.2 | 23.60903260 | 0.01096740 |
| 2.7 | 23.62000000 | 0.00000000 | 6.3 | 23.60742622 | 0.01257378 |
| 2.8 | 23.61999956 | 0.00000044 | 6.4 | 23.60562904 | 0.01437096 |
| 2.9 | 23.61999852 | 0.00000148 | 6.5 | 23.60362346 | 0.01637654 |
| 3.0 | 23.61999694 | 0.00000306 | 6.6 | 23.60139062 | 0.01860938 |
| 3.1 | 23.61999458 | 0.00000542 | 6.7 | 23.59891052 | 0.02108948 |
| 3.2 | 23.61999114 | 0.00000886 | 6.8 | 23.59613024 | 0.02386976 |
| 3.3 | 23.61998616 | 0.00001384 | 6.9 | 23.59317934 | 0.02682066 |
| 3.4 | 23.61997916 | 0.00002084 | 7.0 | 23.58974006 | 0.03025994 |
| 3.5 | 23.61996946 | 0.00003054 | | | |

FIG.9

TRANSLATING ROLLER LIFTER DESIGN FOR DIESEL ENGINES

TECHNICAL FIELD

The present disclosure relates generally to internal combustion engines and, more particularly, to a roller lifter providing reduced wear of the roller and the pin of the lifter and the cam driving the roller lifter caused by rotation of the roller lifter about its longitudinal axis.

BACKGROUND

Internal combustion engines may include poppet valves associated with each combustion chamber and cylinder that open and close at particular times during the combustion cycle to allow a fuel-air mixture to flow into the chamber in an Otto cycle or gasoline engine, to allow air to flow into the chamber in a Diesel cycle engine, or to allow exhaust to flow out of the chamber. In common fuel rail systems, a valve lifter assembly may be configured to drive a push rod and rocker arm to control the position of the corresponding poppet valve. The valve lifter assembly may include lifter body having a pin attached to the valve body, and a roller mounted about the pin and configured to rotate about the pin. The roller may be configured to contact a cam of a cam shaft, which drives the valve lifter assembly up and down to open and close the poppet valve.

For heavy duty applications, the loads on such valve lifter assemblies may be significant, which can cause failure of one or more components of the assembly if the assembly is not constructed robustly. In some cases, the effect that certain loads have on the assembly can be amplified by stress concentrations. For example, in some valve lifter assemblies, stresses can become concentrated at the areas of engagement between the roller and the pin when the valve lifter assembly rotates about its longitudinal axis due to the engine system dynamics and the ends of the roller contact the camming surface of the cam. An amount of rotation of the valve lifter assembly is inevitable and cannot be completely removed from the system. In such cases, the rotational axes of the cam and the roller are not parallel, and the engagement causes shear stresses between the roller and the pin. In addition, the off-center contact between the roller and the cam can cause accelerated wear of their surfaces. These areas of stress concentration can act as the weakest link in an otherwise robust assembly, leading to premature failure of the interfacing components.

Some assemblies have been developed that attempt to reduce stresses in valve lifter and tappet valve assemblies. For example, U.S. Pat. No. 7,748,359, issued to Bartley et al. ("the '359 patent"), discloses a tappet assembly for a machine that may include a tappet body, a pin fixedly mounted in the tappet body, and a substantially cylindrical roller mounted about the pin. The roller may have a substantially cylindrical outer surface with a circumferential dimension and a width dimension defined by two lateral edges of the roller. The roller may be configured to provide rolling contact between the outer surface of the roller and a cam. The outer surface of the roller may be crowned such that at maximum operational loading conditions of the machine, a footprint of contact pressure from the cam is spread substantially the full width of the outer cylindrical surface of the roller. However, with such designs, the roller may contact the surface of the cam along a point or line of contact when rotation of the tappet assembly occurs, thereby creating stress concentrations in the areas of surface-to-surface contact. In addition, similar point contact and shear stress concentrations may occur at the interfacing surfaces between the roller and the pin. In view of this, a need exists for valve lifter assembly designs that can reduce the amount of rotation of the assembly, and reduce the stresses and wear between mating parts when the valve lifter assembly rotation occurs.

SUMMARY OF THE DISCLOSURE

In one aspect of the present disclosure, a valve lifter assembly for an engine is disclosed. The valve lifter assembly may include a valve lifter body, a roller pin mounted in the valve lifter body and having a crowned barrel portion, and a substantially cylindrical roller mounted about the crowned barrel portion of the roller pin. The roller may have a crowned outer surface with a cylindrical center portion having a constant outer diameter equal to a roller maximum outer diameter, and oppositely disposed variable outer diameter outer portions extending outwardly from either side of the cylindrical center portion toward corresponding roller ends of the roller with a roller outer diameter decreasing as the variable outer diameter outer portions extend outwardly from the cylindrical center portion.

In another aspect of the present disclosure, a roller pin for a valve lifter assembly is disclosed. The roller pin may include a crowned barrel portion and oppositely disposed engagement portions extending outwardly from either side of the crowned barrel portion. An engagement portion outer diameter of the engagement portions may be greater than a maximum barrel portion outer diameter of the crowned barrel portion.

In a further aspect of the present disclosure, a roller for a valve lifter assembly is disclosed. The roller may include an inner surface defining a cylindrical inner bore, and a crowned outer surface. The crowned outer surface may have a cylindrical center portion having a constant outer diameter equal to a roller maximum outer diameter, and oppositely disposed variable outer diameter outer portions extending outwardly from either side of the cylindrical center portion toward corresponding roller ends of the roller with a roller outer diameter decreasing as the variable outer diameter outer portions extend outwardly from the cylindrical center portion.

Additional aspects are defined by the claims of this patent.

BRIEF DESCRIPTION OF THE DRAWINGS

FIG. 9 is a table of values of the outer diameter of an outer surface of the roller of FIG. 7.

DETAILED DESCRIPTION

Figure 1:
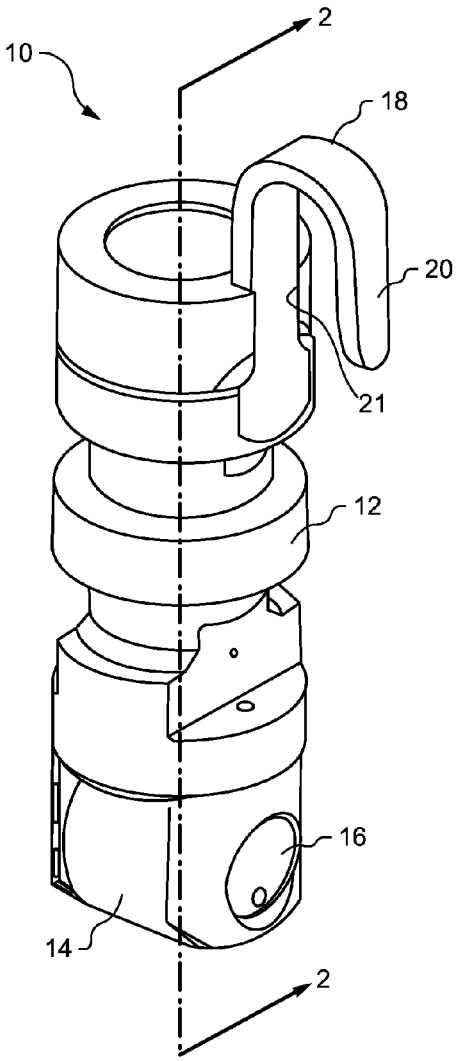
FIG. 1 is a pictorial view of a valve lifter assembly in accordance with the present disclosure.

FIG. 1 illustrates an exemplary valve lifter assembly 10 in accordance with the present disclosure. The valve lifter assembly 10 may be configured to reside within a bore of an engine block and move reciprocally longitudinally or axially therein under the competing forces of a guide spring and a cam of a cam shaft (not shown). The valve lifter assembly 10 may include a valve lifter body 12 that supports a roller 14 mounted for rotation about a roller pin 16. The valve lifter assembly 10 may further include a clip 18 attached at an upper end of the valve lifter body 12. The clip 18 includes a hook 20 extending through a channel or groove 21 of the valve lifter body 12 and above the upper end of the valve lifter body 12 when installed in the engine block. The hook 20 is received within an alignment bore in the engine block to align a rotational axis of the roller 14 and a longitudinal axis of the roller pin 16 substantially parallel to a rotational axis of the camshaft. Because the hook 20 must slide within the alignment bore and due to machining tolerances for the components, the clip 18 can substantially limit rotation of the valve lifter assembly 10 but cannot completely eliminate such rotation. Consequently, the rotational axis for the roller 14 can become slightly skewed relative to the rotational axis of the camshaft and the corresponding cam.

Figure 2:
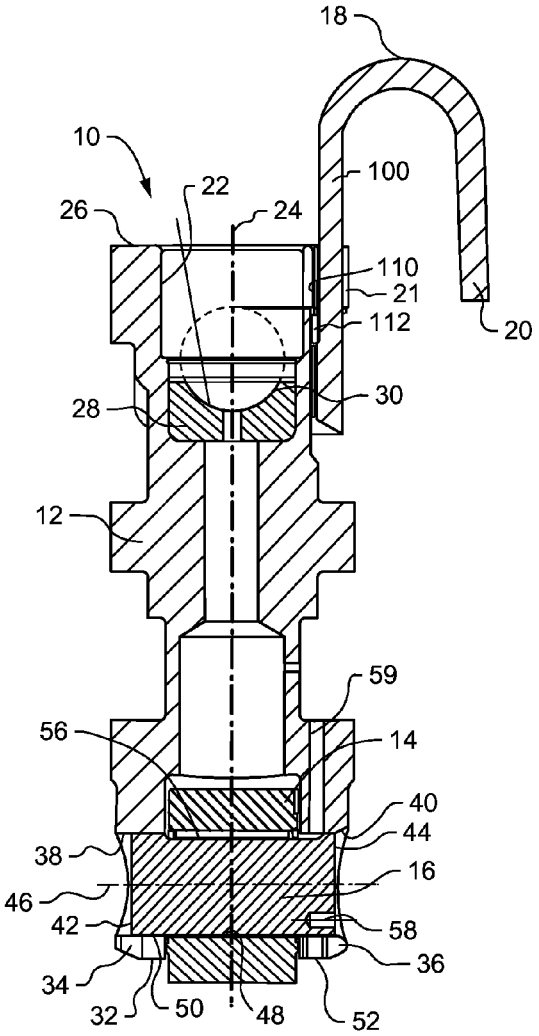
FIG. 2 is a cross-sectional view of the valve lifter assembly of FIG. 1 taken through line 2-2.

The components of the valve lifter assembly 10 are shown in greater detail in the cross-sectional view of FIG. 2. The valve lifter body 12 includes a through bore 22 extending there through and having a varying inner diameter as the through bore 22 extends along a longitudinal axis 24 of the valve lifter body 12. Proximate an upper end 26 of the valve lifter body 12, the through bore 22 is configured to receive an insert 28. The insert 28 includes a concave upper surface 30 configured to receive a ball and ends of a guide spring and a push rod (not shown) that will transmit the longitudinal movement of the valve lifter assembly 10 under the influence of the cam to a corresponding rocker arm and ultimately to a poppet valve (not shown).

At a lower end 32 of the valve lifter body 12, a pair of downwardly extending ears 34, 36 may define openings 38, 40 that may be dimensioned to receive and engage corresponding pin ends 42, 44 of the roller pin 16. The openings 38, 40 and the roller pin 16 may be dimensioned so that the roller pin 16 must be press fit into the openings 38, 40 during assembly and retained therein without rotation about a longitudinal axis 46 of the roller pin 16. The opening 40 may be countersunk or beveled to guide the pin end 42 of the roller pin 16 into the opening 40. Of course, before insertion of the roller pin 16, the roller 14 is disposed between the ears 34, 36 so that the pin end 42 of the roller pin 16 may pass through an inner surface defining an axial bore 48 through the roller 14. To minimize wear caused by the combination of axial and rotational movement of the valve lifter assembly 10 within the engine block bore, the valve lifter body 12 may be formed from steel and heat treated by an appropriate process to a Rockwell C hardness of 55 or above.

Figure 3:
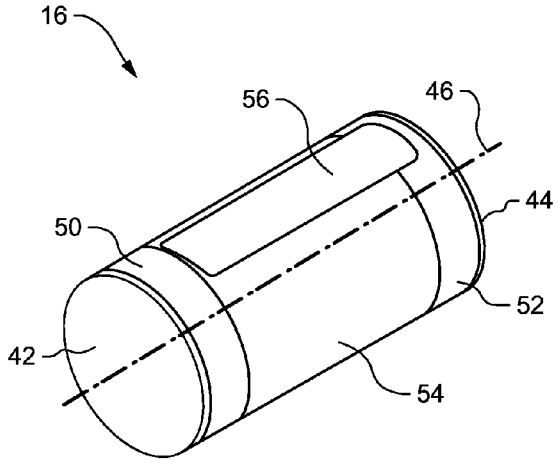
FIG. 3 is a pictorial view of a roller pin of the valve lifter assembly of FIG. 1.
Figure 4:
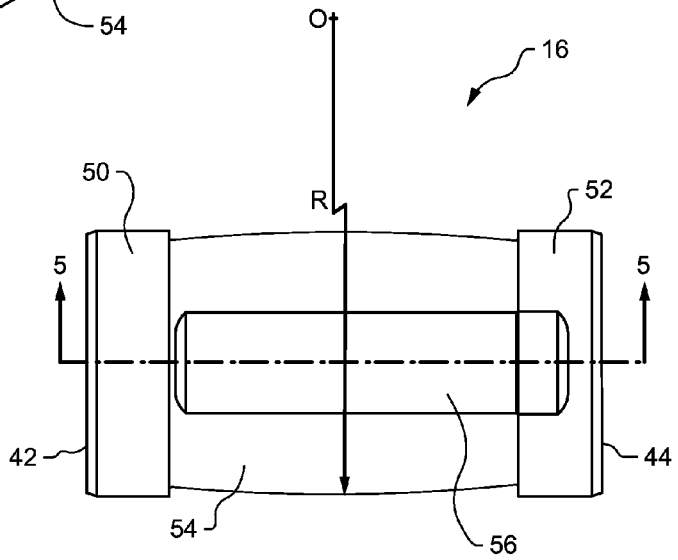
FIG. 4 is a top view of the roller pin of FIG. 3.
Figure 5:
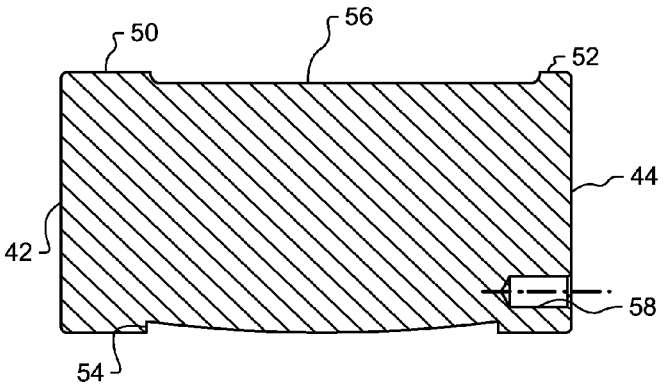
FIG. 5 is a cross-sectional view of the roller pin of FIG. 3 taken through line 5-5 of FIG. 4.

The roller pin 16 is shown in greater detail in FIGS. 3-5. Referring to FIG. 3, the roller pin 16 has a generally cylindrical shape and is centered about the longitudinal axis 46. Despite the generally cylindrical shape, the roller pin 16 has a variable outer diameter to accommodate both engagement and retention within the openings 38, 40 of the valve lifter body 12, and relative motion of the roller 14 when mounted thereon. The roller pin 16 includes oppositely disposed cylindrical engagement portions 50, 52 and a central barrel portion 54 disposed there between. The engagement portions 50, 52 may have approximately constant outer diameters across their outer surfaces as they extend from the barrel portion 54 toward the corresponding pin ends 42, 44 where the engagement portions 50, 52 terminate at chamfered edges that facilitate insertion through the openings 38, 40. As seen in FIG. 4 where the curvature of the barrel portion 54 is exaggerated for purposes of illustration, the barrel portion 54 may have a smaller maximum outer diameter than the engagement portions 50, 52. In contrast, however, the barrel portion 54 may be crowned or barrel-shaped and have an outer diameter that varies from a maximum value at a longitudinal center of the roller pin 16 to minimum outer diameters at the intersections of the barrel portion 54 with the engagement portions 50, 52.

In the illustrated embodiment, the crown of the barrel portion 54 may have a circular curvature having a large radius R about an origin O. In an exemplary embodiment, the roller pin 16 may have an overall length of approximately 24.70 mm (approximately 0.9724 inch), with the barrel portion 54 being approximately 16.90 mm (approximately 0.6654 inch) and each of the engagement portions 50, 52 being approximately 3.90 mm (approximately 0.1535 inch) wide. The engagement portions 50, 52 may have an outer diameter approximately equal to 12.70 mm (0.5 inch), and the barrel portion 54 may have a maximum outer diameter approximately equal to 12.66 mm (0.4984 inch) at the longitudinal center of the roller pin 16. The curvature of the outer surface of the barrel portion 54 may have a radius R of approximately 1200.00 mm (approximately 47.24 inches). Despite the relatively large radius R, the decrease in the outer diameter as the barrel portion 54 extends outwardly from the longitudinal center is sufficient to allow movement of the roller 14 relative to the roller pin 16 as will be discussed further below.

To reduce friction and wear between the roller 14 and the roller pin 16, the pin 16 may be fabricated from bronze, or may be fabricated from steel and have a diamond-like coating (DLC) applied thereto. To further reduce friction and wear, lubricant is provided at the interface between the roller 14 and the roller pin 16. In previous implementations such as that shown in the '359 patent referenced above, configurations of internal lubrication channels, openings through the outer surface of the roller pin, an annular grooves in the outer surface of the roller pin had been provided. Such flow paths are eliminated in the roller pin 16 accordance with the present disclosure. As best seen in FIGS. 4 and 5, the roller pin 16 includes a flattened lubrication channel 56 extending longitudinally substantially across the entire width of the barrel portion 54 and continuing partially across the engagement portion 52. As seen in FIG. 5, the lubrication channel 56 is disposed radially inwardly from the outer surfaces of the engagement portions 50, 52. The removal of material at the lubrication channel 56 could cause stress concentrations and wear if the lubrication channel 56 is not oriented properly at a substantially unloaded location.

To ensure proper alignment of the roller pin 16, an alignment bore 58 may be provided through the pin end 44 at a location diametrically opposite the lubrication channel 56 to provide a visual indication of the alignment of the roller pin 16. Referring back to FIG. 2, the roller pin 16 may be installed through the openings 38, 40 with the lubrication channel 56 disposed at the top and the alignment bore 58 disposed at the bottom to ensure that the roller pin 16 is properly aligned. Maximum loads will be experienced between the roller 14 and the roller pin 16 at the bottom where the roller 14 is engaged by the cam. The top of the roller pin 16 at the lubrication channel 56 is relatively unloaded so that the reduction in material for the lubrication channel 56 will not cause excessive stress concentrations. Lubricant is provided to the lubrication channel 56 via a lubrication passage 59 through the valve lifter body 12 that aligns with the portion of the lubrication channel 56 extending into the engagement portion 52.

Figure 6:
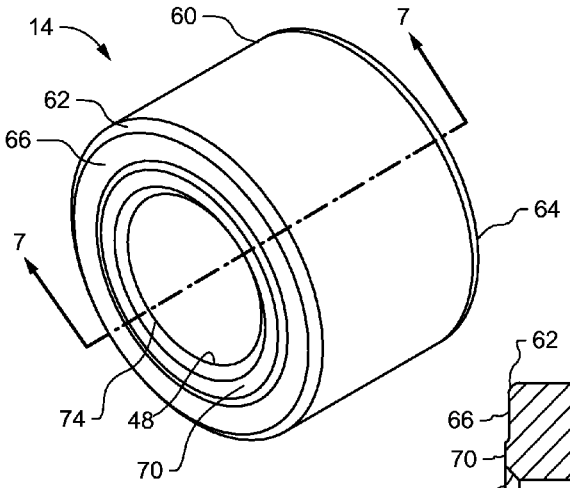
FIG. 6 is a pictorial view of a roller of the valve lifter assembly of FIG. 1.
Figure 7:
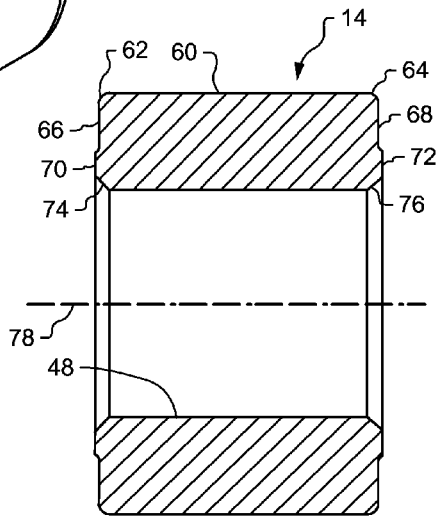
FIG. 7 is a cross-sectional view of the roller of FIG. 6 taken through line 7-7.
Figure 8:
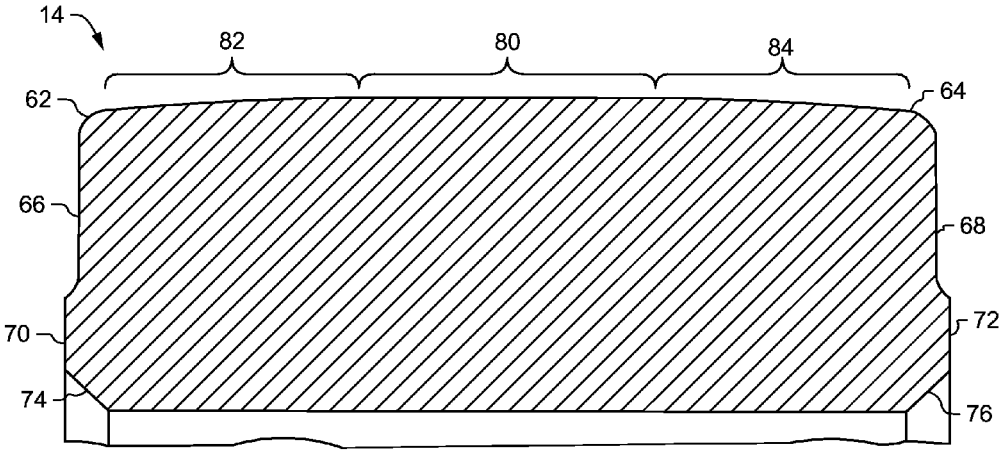
FIG. 8 is an enlarged cross-sectional view of an upper portion of the roller of FIG. 7.

FIGS. 6-8 illustrate the roller 14 in accordance with the present disclosure in greater detail. The roller 14 may have a substantially cylindrical and crowned outer surface 60 to go along with the axial bore 48 that may have a substantially uniform inner diameter. Referring to FIGS. 6 and 7, the roller 14 may have oppositely disposed rounded lateral edges 62, 64 transitioning from the outer surface 60 to roller end walls 66, 68, respectively. Each roller end wall 66, 68 may have a corresponding annular hub portion 70, 72, respectively, extending outwardly there from and having reduced outer diameters from the outer surface 60. The reduced diameter hub portion 70, 72 may reduce the lateral loading exerted by the roller 14 on the ears 34, 36 of the valve lifter body 12 and provide spacing of the majority of the roller end walls 66, 68 from corresponding inner surfaces of the ears 34, 36. Proximate the intersection with the hub portion 70, 72, the axial bore 48 may have chamfered or countersunk end portions 74, 76 that may assist in guiding the roller pin 16 into the axial bore 48 during assembly.

In previously known valve lift assemblies, outer surfaces of the rollers have had constant outer diameters or curved or crowned outer surfaces having varying outer diameters across the outer surface and with a maximum outer diameter at a longitudinal center of the roller as shown, for example, in the '359 patent. In the crowned roller designs, when a longitudinal axis of the roller is aligned parallel to the rotational axis of the cam, the outer surface and the cam engage at a point of contact or, if the metals are soft enough, an area of contact if one or both surfaces deforms under heavy loading. In contrast, the crowned outer surface 60 of the roller 14 in accordance with the present disclosure provides increased surface area of engagement between the outer surface 60 of the roller 14 and the cam during both alignment of the longitudinal axis 78 of the roller 14 and rotational axis of the cam, and misalignment due to rotation of the valve lifter assembly 10 about its longitudinal axis 24.

Referring to FIG. 8 where the curvature of the crowned outer surface 60 is exaggerated for purposes of illustration, the outer surface 60 in accordance with the present disclosure may be designed with a more complex crown shape than previous rollers. The outer surface 60 may be divided into a maximum outer diameter center portion 80 and variable outer diameter outer portions 82, 84. The center portion 80 may be centered about a longitudinal center of the roller 14 and have a constant outer diameter equal to the maximum outer diameter of the outer surface 60. The outer portions 82, 84 disposed on either side of the center portion 80 may have outer diameters that decrease from the outer surface maximum outer diameter at the transition from the center portion 80 to a minimum outer diameter at the transitions to the lateral edges 62, 64, respectively. The rate of decrease of the outer diameter of the outer surface 60 may be determined based on the particular implementation and geometry of the components of the valve lifter assembly 10 and the cam. For example, the outer diameter may decrease at a constant rate across the outer portions 82, 84, or the outer diameter decrease may be described by a circular arc.

In particular embodiments, the outer diameter may decrease at a logarithmic rate so that the outer diameter decreases gradually from the maximum outer diameter proximate the center portion 80 and then decreases at a greater rate as the outer portions 82, 84 extend toward the lateral edges 62, 64. For example, in an embodiment that may be compatible and complementary with the embodiment of the roller pin 16 set forth above, the axial bore 48 may have an inner diameter approximately equal to 12.79 mm (0.5035 inch), and the outer surface 60 may have a maximum outer diameter approximately equal to 23.62 mm (0.9299 inch). The roller 14 may have an overall width of approximately 16.00 mm (approximately 0.6299 inch), and the combined width of the center portion 80 and the outer portions 82, 84 may be approximately equal to 14.00 mm (0.5512 inch). The center portion 80 may have a width approximately equal to 5.4 mm (0.2126 inch) and be centered at the longitudinal center of the roller 14, and each of the outer portions 82, 84 may be approximately 4.3 mm (approximately 0.1693 inch) wide. The outer diameter profile of the outer surface 60 of the exemplary roller 14 is provided in FIG. 9 wherein a table 90 shows the progression of the outer diameter in 0.1 mm (0.003937 inch) increments as the outer surface 60 extends from the longitudinal center of the roller 14. The outer surface 60 maintains a constant outer diameter of approximately 23.62 mm (approximately 0.9299 inch) in the center portion 80, followed by the outer diameter decreasing at an increasing rate in the variable outer diameter outer portions 82, 84. Those skilled in the art will understand that the data in table 90 may be scaled accordingly or otherwise modified from this particular logarithmic progression based on the particular dimensions of the roller 14 and the valve lifter assembly 10 in which the roller 14 is implemented.

Figure 10:
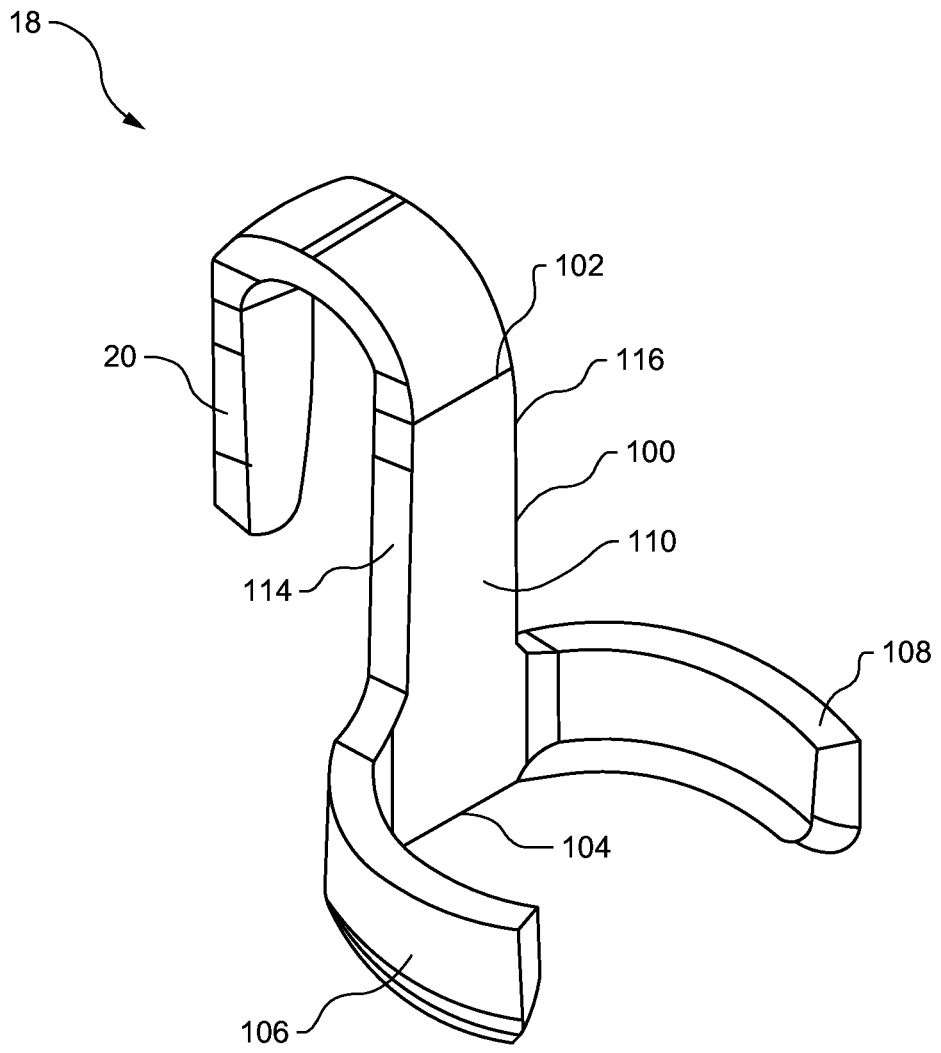
FIG. 10 is a pictorial view of a clip of the valve lifter assembly of FIG. 1.

FIG. 10 illustrates an embodiment of the clip 18 in accordance with the present disclosure. The clip 18 may include a vertical body portion 100 from which the hook 20 extends at an upper end 102. At a lower end 104, the clip 18 may include a pair of curved clip arms 106, 108 extending outwardly from either side of the body portion 100. The clip arms 106, 108 are configured to slip on to and partially encircle the valve lifter body 12 as shown in FIGS. 1 and 2 to retain the clip 18 in place with the body portion 100 disposed within the channel 21 of the valve lifter body 12 (FIG. 1). The body portion 100 includes an inwardly facing engagement surface 110 that faces and engages a corresponding planar engagement surface 112 of the valve lifter body 12 and lateral sides 114, 116 that face and engage corresponding sides of the channel 21.

In previously known valve lifter assemblies, clips are fabricated from spring steel in a stamping process that may be imprecise with respect to the exact dimensions and geometry of the elements of the clip 18. For example, the engagement surface 110 as formed by the stamping process typically has a curvature making the surface 110 concave or convex in shape. With either curvature, the engagement surface 110 is not complementary to the planar surface 112 of the valve lifter body 12, and the contact area between the surfaces 110, 112 is reduced. The reduced contact area can lead to stress concentrations, excess wear and potential failure of the clip 18 at the vertical body portion 100. In the present embodiment, the engagement surface 110 is machined to substantially eliminate any curvature of the engagement surface 110 and make the surface 110 complementary to the planar surface 112. With the curvature reduced or eliminated, the surfaces 110, 112 are able to face and engage with a maximum amount of contact area between the surfaces 110, 112. In a similar way, the sides 114, 116 may be machined to have complimentary shapes with the corresponding sides of the channel 21 and maximize contact between the surfaces as the body portion 100 slides within the channel 21. Stresses and wear may be further reduced by heat treating the clip 18 with an appropriate process that can achieve a Rockwell C hardness within a range of approximately 42-50.

INDUSTRIAL APPLICABILITY

The design features in the roller 14, the roller pin 16 and the clip 18 function together to make the valve lifter assembly 10 less susceptible to accelerated wear and failure caused by rotation of the valve lifter assembly 10. The combination of features reduces loading when rotation occurs, and also reduces the instances and magnitude of the rotation that does occur.

The logarithmic complex crown on the outer surface 60 of the roller 14 helps to keep the roller 14, or restore the roller 14 to being, guided in a straight path on the cam with the longitudinal axis 78 parallel to the rotational axis of the cam. The constant outer diameter center portion 80 of the outer surface 60 provides additional contact surface area when the longitudinal axis 78 is aligned parallel to the rotational axis of the cam. The variable outer diameter outer portions 82, 84 having a logarithmic progression to reducing the outer diameter of the outer surface 60, such as that shown in the table 90 of FIG. 9, provide additional contact surface area between the outer surface 60 and the camming surface when the roller 14 and/or the valve lifter assembly 10 rotate the longitudinal axis 78 out of parallel alignment with the rotational axis of the cam. The complex crown having gradual transitions between the center portion 80 and the outer portions 82, 84 further provides for smoother transitions and less severe jolts to the components of the valve lifter assembly 10 as the longitudinal axis 78 of the roller 14 rotates into and out of parallel alignment with the rotational axis of the cam.

The crowned barrel portion 54 of the roller pin 16 provides a measure of flexibility for the valve lifter body 12 and the roller 14 to rotate relative to each other about the longitudinal axis 24 of the valve lifter body 12 or other rotational axes that are perpendicular to the longitudinal axis 78 of the roller 14. Slight rotation of the valve lifter body 12 due to the dynamics of the engine may be able to occur without the barrel portion 54 engaging the axial bore 48 of the roller 14 and rotating the roller 14 out of alignment with the cam surface. Similarly, the roller 14 may rotate slightly relative to the valve lifter body 12 without causing corresponding rotation of the valve lifter body 12 or generating concentrated shear stresses on the roller pin 16. Moreover, elimination of an annular lubrication groove in the outer surface of the roller pin 16 reduces stress concentrations and wear on the axial bore 48 of the roller 14 by presenting a continuous surface at the high load area between the roller 14 and the roller pin 16.

Machining of the engagement surface 110 of the clip 18 and the sides 114, 116 to match the planar configuration of the engagement surface 112 of the valve lifter body 12 and the sides of the channel 21 provides greater contact area between the clip 18 and the valve lifter body 12. The increased contact area allows loads to be more evenly distributed across the surfaces 110, 112 and thereby reduce stresses created in the components. The increased contact area also reduces the wear experienced by the surfaces 110, 112. Moreover, the increased contact area reduces the forces and stresses experienced by the body portion 100 of the clip 18 and the groove of the valve lifter body 12 in which the body portion 100 of the clip 18 resides when attached.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A valve lifter assembly for an engine, comprising:

a valve lifter body;

a roller pin mounted in the valve lifter body and having a crowned barrel portion; and a roller substantially cylindrical in shape mounted about the crowned barrel portion of the roller pin, the roller having a crowned outer surface with a cylindrical center portion having a constant outer diameter equal to a roller maximum outer diameter and extending for about a third of a width of the roller, and variable outer diameter outer portions disposed opposite each other and extending outwardly about a third of a width of the roller from either side of the cylindrical center portion toward corresponding roller ends of the roller with a roller outer diameter decreasing as the variable outer diameter outer portions extend outwardly from the cylindrical center portion.

2. The valve lifter assembly according to claim 1, wherein a barrel outer surface of the crowned barrel portion is curved in cross-section.

3. The valve lifter assembly according to claim 2, wherein a barrel curvature of the barrel outer surface of the crowned barrel portion is described by a circular arc.

4. The valve lifter assembly according to claim 1, wherein the roller pin comprises oppositely disposed engagement portions extending outwardly from either side of the crowned barrel portion and engaged by the valve lifter body to retain the roller pin, wherein an engagement portion outer diameter of the engagement portions is greater than a maximum barrel portion outer diameter of the crowned barrel portion.

5. The valve lifter assembly according to claim 4, wherein the roller pin includes a lubrication channel extending longitudinally in an outer surface of the roller pin substantially entirely across the crowned barrel portion and partially extending across one of the engagement portions from an intersection of the crowned barrel portion with the one of the engagement portions.

6. The valve lifter assembly according to claim 5, wherein the valve lifter body includes a lubrication passage, and a portion of the one of the engagement portions into which the lubrication channel extends is aligned with the lubrication passage for receipt of a lubricant provided through the lubrication passage.

7. The valve lifter assembly according to claim 1, wherein the variable outer diameter outer portions of the roller are curved in cross-section.

8. The valve lifter assembly according to claim 1, wherein the roller outer diameter decreases at an increasing rate as the variable outer diameter outer portions extend outwardly from the cylindrical center portion.

9. The valve lifter assembly according to claim 8, wherein the roller outer diameter in the variable outer diameter outer portions is described by a circular arc.

10. The valve lifter assembly according to claim 8, wherein the roller outer diameter decreases according to a logarithmic progression as the variable outer diameter outer portions extend outwardly from the cylindrical center portion.

11. The valve lifter assembly according to claim 1, comprising a clip having a clip vertical body portion, a pair of curved clip arms extending outwardly from opposite sides of the clip vertical body portion proximate a lower end of the clip vertical body portion and partially encircling the valve lifter body to retain the clip thereon, and a clip hook extending from an upper end of the clip vertical body portion.

12. The valve lifter assembly according to claim 11, wherein the valve lifter body includes an engagement surface, and the clip vertical body portion includes a clip engagement surface that faces and engages the engagement surface of the valve lifter body when the clip is mounted thereon, wherein the clip engagement surface is machined to have a substantially planar shape that is complimentary to a substantially planar shape of the engagement surface of the valve lifter body.

13. A roller pin for a valve lifter assembly, comprising:

a crowned barrel portion; and oppositely disposed engagement portions extending outwardly from either side of the crowned barrel portion, wherein an engagement portion outer diameter of the engagement portions is greater than a maximum barrel portion outer diameter of the crowned barrel portion, and a lubrication channel extending longitudinally in an outer surface of the roller pin substantially entirely across the crowned barrel portion and partially extending across one of the engagement portions.

14. The roller pin according to claim 13, wherein a barrel outer surface of the crowned barrel portion is curved in cross-section.

15. The roller pin according to claim 14, wherein a barrel curvature of the barrel outer surface of the crowned barrel portion is described by a circular arc.

16. A roller for a valve lifter assembly, comprising:

an inner surface defining a cylindrical inner bore; and a crowned outer surface with a cylindrical center portion having a constant outer diameter equal to a roller maximum outer diameter and extending for about a third of a width of the roller, and variable outer diameter outer portions disposed opposite each other and extending outwardly about a third of a width of the roller from either side of the cylindrical center portion toward corresponding roller ends of the roller with a roller outer diameter decreasing as the variable outer diameter outer portions extend outwardly from the cylindrical center portion.

17. The roller according to claim 16, wherein the variable outer diameter outer portions of the roller are curved in cross-section.

18. The roller according to claim 16, wherein the roller outer diameter decreases at an increasing rate as the variable outer diameter outer portions extend outwardly from the cylindrical center portion.

19. The roller according to claim 18, wherein the roller outer diameter decreases according to a logarithmic progression as the variable outer diameter outer portions extend outwardly from the cylindrical center portion.

* * * * *